US006821382B1

(12) United States Patent
Lundgren

(10) Patent No.: US 6,821,382 B1
(45) Date of Patent: Nov. 23, 2004

(54) METHOD AND ARRANGEMENT FOR CLEANING CONTAMINATED CONDENSATE INCLUDING A COMBINED STRIPPER/CONDENSER

(75) Inventor: Allan Lundgren, Domsjö (SE)

(73) Assignee: Papsea AB, Ornskoldsvik (SE)

( * ) Notice: Subject to any disclaimer, the term of this patent is extended or adjusted under 35 U.S.C. 154(b) by 0 days.

(21) Appl. No.: 09/720,949

(22) PCT Filed: Jul. 5, 1999

(86) PCT No.: PCT/SE99/01219

§ 371 (c)(1),
(2), (4) Date: Jan. 29, 2001

(87) PCT Pub. No.: WO00/01879

PCT Pub. Date: Jan. 13, 2000

(30) Foreign Application Priority Data

Jul. 7, 1998 (SE) ..... 9802442

(51) Int. Cl.[7] ..... B01D 1/26; D21C 11/10; D21C 11/06

(52) U.S. Cl. ..... 159/47.3; 159/29; 159/DIG. 8; 159/DIG. 16; 159/17.1; 202/205; 202/234; 202/174; 202/186; 203/14; 203/73; 203/78; 203/79; 203/87; 162/16; 162/47; 162/36

(58) Field of Search ..... 162/17, 29, 51, 162/16, 47, 36; 159/47.1, 47.3, 17.1, DIG. 16, DIG. 8, 29; 202/205, 234, 174, 186; 203/87, 91, 92, 98, 14, 93, 73, 78, 79, 39, 100; 530/200

(56) References Cited

U.S. PATENT DOCUMENTS 3,950,448 A 4/1976 Witt
4,002,525 A 1/1977 Baierl
4,137,134 A 1/1979 Suominen et al.
6,261,412 B1 * 7/2001 Ryham ..... 162/17

FOREIGN PATENT DOCUMENTS

EP 0 188 019 A1 7/1986
SE 503 351 C2 5/1996

* cited by examiner

*Primary Examiner*—Virginia Manoharan
(74) *Attorney, Agent, or Firm*—Ware, Fressola, Van der Sluys & Adolphson LLP

(57) ABSTRACT

A method and apparatus for cleaning condensate, produced during the production of cellulose pulp, including evaporation of spent liquor, utilizing a cleaning plant having several condensers, coupled in series. Process steam from the last evaporation stage and unclean condensate are introduced into a combined stripper/condenser, the process steam and the condensate being brought to flow in opposite directions so that direct heat exchange occurs, resulting in volatile compounds of the condensate being separated and taken up by the steam with simultaneous indirect cooling, resulting in condensation of the main part of the process steam, and the remaining process steam gradually flowing further on, the process steam being successively cooled first resulting in water and turpentine being condensed and collected and subsequently methanol being condensed. The liquid water portion is separated from the turpentine, which is removed from the plant, and the water portion of the condensate is reintroduced to the stripper/condenser. Methanol is also separated and removed from the plant, and cleaned condensate is collected at the bottom of the combined stripper/condenser and removed from the plant or is further purified.

21 Claims, 4 Drawing Sheets

METHOD AND ARRANGEMENT FOR CLEANING CONTAMINATED CONDENSATE INCLUDING A COMBINED STRIPPER/CONDENSER

TECHNICAL FIELD

The invention relates to a method and a plant for cleaning contaminated condensate emanating from pulp production of semichemical and chemical cellulose pulp, including evaporation of spent liquor.

BACKGROUND OF THE INVENTION

When producing chemical cellulose pulps a lignocellulose material, for instance wood in the form of chips, is dissolved employing either an acid or alkaline process. During a cooking step lignin which forms the middle lamella between wood fibers goes into solution in a cooking liquid, and the fibers after digestion are separated from each other and form a cellulose pulp. Aside from the lignin content of the wood, a considerable part of the hemicellulose in the wood also goes into solution. How much is determined by the pulping degree, which in general is represented as cooking yield in percent. Also a minor part of the wood cellulose content goes into solution. An example of an acid cooking process is the sulphite process and an example of the alkaline cooking process is the sulphate process.

Other known alkaline cooking processes are the polysulfide pulping process and soda type (sodium hydroxide) process, in which catalysts such as quinone compounds can be used. Included within the sulphate process is utilization of high sulfidity pulping to counter current cooking, in which white liquor (primarily a mixture of sodium hydroxide and sodium sulphide) is added during the cooking phase and utilization of a chemical treatment of lignocellulose material, prior to the sulphate pulping process.

The sulphite method can be classified according to the base used in the cooking liquor, as calcium, magnesium, ammonium and sodium. There are sodium and magnesium cooking liquors, which are usually recovered.

After pulping the lignocellulose material, the cooking liquor is separated from the fibers. The spent cooking liquor known as black liquor is referred to as thin liquor in connection with recovery, the main part of thin liquor being water. The dry solid content in thin liquor (lignin, hemicellulose, cellulose, residual chemicals, etc.) is for instance within the range 15–20%. Before combustion of the thin liquor in a recover boiler with combustion of the organic compounds to mainly carbon dioxide and water with recovery of energy and permitting the inorganic compounds to form a residual in the form of a smelt along with recover of the liquor for production of new cooking liquor, the dry solid content must be increased to at least 55%. This liquor with the increased dry solid content is referred to as black liquor or thick liquor. The thick liquor is created by evaporation of thin liquor in five to seven steps. Each step is referred to as a stage.

Modern mills for production of chemical cellulose pulp attempt to reduce fresh water consumption as much as possible and also attempt to reduce the discharge of waste liquor. This may be achieved by closure of the liquid system to a higher or lower degree. This means that spent liquor from bleaching stages must be reused and may be mixed with spent cooking liquor. Thin liquor is therefore sometimes a mixture of spent cooking liquor and spent liquor from different types of bleaching.

During evaporation of thin liquor, condensate is generated. Condensate at some locations may be relatively clean, and can therefore be used at one of several positions in the pulp mill. At other locations contaminated condensate is generated. According to the present invention, it is imperative that heavily contaminated condensate be cleaned. Production of chemical cellulose pulp also generates other types of unclean condensate. Digesting of lignocellulose material is done under pressure such that after cooking a gas mixture is released from the digester and this mixture contains steam as well as organic- and inorganic compounds. During conventional batchwise cooking spent liquor leaves the digester together with generated cellulose pulp. The gas mixture may be condensed to a so-called cooking condensate. Gas mixtures are also collected at other places in the cooking plant and those are condensed, and are also known as cooking condensate and not blow steam condensate. Cooking condensate is generated during batch wise and continuous cooking of lignocellulose material. The contaminated cooking condensate is mixed with unclean evaporation condensate and that mixture may be cleaned according to the present invention. According to the present invention, it is possible to clean the condensate separately, but that is not preferred.

There are several semichemical pulping processes. An example is the neutral sulphite semichemical process, (NSSC). The pulping degree is very low for that type of process; mechanical defibration is therefore necessary for liberation of fibres. In some cases, the pre-treatment liquor or the cooking liquor is recovered. If the recovered liquor is evaporated, the present invention can be used.

For cleaning of unclean condensate according to conventional techniques, at least one stage called stripping is used. Stripping means that the unclean condensate is blown with steam such that volatile compounds in the contaminated condensate follow the steam flow and leave the condensate. According to conventional technique, separate or detached stripper plants are used. The steams used in the stripper plants are admission steams generated in the recovery boiler, or steam from any evaporator stage in the evaporation plant. Further, the stripper plants operate at atmospheric- or over pressure.

In Swedish letters patent 7704352-9 (423915) a method is described for recovery of sulphur compounds, volatile alcohols such as methanol and by-products such as turpentine or similar compounds from contaminated condensate. According to the described method, stripping is performed in two positions, one at the top of a rebuilt evaporation stage resulting in a more expensive evaporation plant and the other in a detached stripper. In the detached stripper, steam from the last evaporation stage is used for stripping of contaminated condensate. The use of the steam for the last evaporation stage provides an economic advantage. However the utilization of steam is limited to 20–25% of the total amount steam from the last evaporation stage. The surplus steam from the last evaporation stage is condensed in a conventional manner by using condensers and heat exchangers. As coolant, normally fresh water is used, resulting in production of warm water with low value.

DETAILED DESCRIPTION OF THE INVENTION

The known technique for cleaning of unclean condensate, as described above, is uneconomical. The reason for that is that stripping is performed in separate or detached plants with the use of high value steam, mainly admission steam.

The present invention solves this problem and relates to a method for cleaning of unclean condensate arising from pulp production of chemical or semichemical pulp. The invention involves evaporation of spent liquor using a cleaning plant having in series several coupled condensers, characterized in that vapour generated at the last evaporation stage, i.e. process steam from the last evaporation stage which has the lowest steam pressure, and unclean condensate, feed a combined stripper and condenser, in which process steam and the unclean condensate flow counter current so that heat exchanging take place between the process steam and unclean condensate. This results in volatile compounds in the condensate being separated from the condensate and following the flow of process steam at the same time as indirect cooling occurs, resulting in condensation of the main part of the process steam. The rest or uncondensed portion of the process steam flows to another condenser, in which the remaining process steam successfully cools indirectly, resulting in water and turpentine condensing and collecting together. Methanol thereafter condenses. The first mentioned collected condensate is separated from the main part of the turpentine content, and is removed from the plant. Residual condensate is fed back to the combined stripper/condenser and the condensed methanol removed from the plant. Primary cleaned condensate collects at the bottom of the combined stripper/condenser and is also removed from the plant or will be further purified. It is highly stressed according to the invention, that all process steam from the evaporation plant last stage i.e. process steam with the lowest vapour pressure, feeds the combined stripper/condenser.

It is optimal if the amount of process steam from the last evaporation stage corresponds to the amount of steam necessary for purification of the unclean condensate, as described. A surplus of available process steam doesn't create a problem, as the excess steam can be used for production of warm water according to conventional technique. A shortage of available process steam means that additional steam must be added i.e. admission steam, for achieving a good cleaning result. In some pulp mills more or less generated process steam can be used in other places in the mill, and therefore may not be available for purification of unclean condensate as described. If shortages of process steam arise, additional steam must be added i.e. admission steam. To proceed in that way is not preferred.

It is suitable for unclean condensate to enter into a space above and connected to the combined stripper/condenser and for process steam to enter a space under and in connection with the combined stripper/condenser, and for the unclean condensate to flow in the direction from the top and downwards through the combined stripper/condenser, while the process steam flows in the opposite direction. In the space above and in connection with the combined stripper/condenser, de-aeration steam can be introduced from one or more evaporation stages. In such cases there will not be any cleaning of condensate, but the reason for proceeding in that manner is to condense the unclean process steam and recover contaminating chemicals for purposes of environmental protection.

According to a preferred embodiment of the invention, the primary cleaned condensate flows downward through an underlying extension of a combined stripper/condenser and the primary cleaned condensate is heated indirectly with steam from de-aeration of one or more evaporation stages. The de-aeration steam enters the under part of the extension, resulting in any remaining volatile compounds separating from primary cleaned condensate as a gas and flowing upward and mixing with the upward flowing newly introduced process steam. Highly purified condensate is collected at the extension bottom and thereafter may be removed from the plant. In one embodiment of the invention, de-aeration steam can be reinforced with admission steam of variable energy content so that the cleanliness of the condensate can be controlled. It is important that the purified condensate be as clean as possible. The reason for that is that purified condensate is used in several places in the mill i.e. pulp-washing and in different positions in the bleachplant, and the condensate may also be sent into a sewer. Any remaining organic compounds in the purified condensate may have an adverse effect on the environment if the condensate is disposed of in a sewer. Condensate used in different positions in the mill may also have an indirect influence on the environment.

Conventional methods for cleaning of contaminated condensate have a cleaning efficiency of 90%. A higher cleaning efficiency is desirable and very significant.

By use of the mentioned admission steam, it is possible to further increase the already good cleaning efficiency which is achieved with the previous described embodiment. A cleaning efficiency of 95% and even higher is possible. It is true that adding of admission steam is against one of the important principals of the invention, namely that only low value steam, i.e. cheap steam, shall be used for cleaning of unclean condensate. However, the improvement that can be reached by means of the described addition of admission steam is very favourable in comparison with other cleaning alternatives and also is an advantage from an economical point of view.

The remaining part of the de-aeration steam, for indirect heating, leaves the extension part at the upper end. The surplus de-aeration steam enters the space at the top of the cleaning plant, the combined stripper/condenser. The reason for that has been described earlier.

According to another preferred embodiment of the invention, there is a vacuum creating apparatus connected to the discharge unit in the heating plant. This results in the removal of inert gases and foul smelling sulphur containing gases from the plant. By inert gases is meant that the gases will not condense under present conditions, not that the gases are chemically inert. These inert gases are sent to an incineration plant for destruction of the sulphur containing gases, according to known techniques. As low pressure is created in the device for cleaning of unclean condensate, process steam with temperatures below 100° C. can be used. The temperature of the process steam can, for example, be 50–65° C. Cleaning of contaminated unclean condensate is performed, as described earlier, in several steps and a suitable number of steps is four. The condensed methanol is collected in the bottom of the last condenser in series, a part of the condensed methanol enters a space above or in close connection with the next to the last condenser in series and the rest of the methanol is removed from the plant. The process steam removes impurities in the unclean condensate; the impurities are then recovered by condensation of the further contaminated condensate. To achieve condensation, coolant has to be introduced in to each step and heated coolant has to be removed in several positions. Accordingly the coolant is introduced at the upper end of the first condenser, i.e. the combined stripper/condenser and is removed at a higher temperature from the bottom end, or alternatively is removed at the middle section of the first condenser. Any coolant can be used, but cold water is preferable.

The invention also is applicable to a plant for cleaning of contaminated condensate emanating from production of semichemical or chemical pulp, including evaporation of spent liquor. In such an application the invention utilizes several in series of coupled condensers, including a first unit in the form of a combined stripper/condenser having several insertions, or insertion means, through which process steam and unclean, contaminated, condensate flow counter current and with direct contact between the process steam and the unclean condensate. The insertions are surrounded with a closed space for a cooling agent and a space above and under the unit. The space under the unit serves as a bottom. There are also means for supply of unclean condensate to the space at the upper end of the unit, means for supply of process steam to the space at the bottom end of the unit, means for supply of cooling agent at one end of the unit, means for removal of heated cooling agent at the opposite end of the unit, means for removal of primary purified condensate, further condensers for residual steam from the first condenser, having several insertions through which only process steam and steam generated from condensate flows, and not condensed process steam itself. The insertions are surrounded with a closed space for cooling agent. This results in condensation in series of contaminated water, and turpentine in a mixture and lastly methanol. There are also means for supply of a cooling agent at one side of the condenser and means for removal of the above mentioned condensate mixture from the space on the bottom end of the condenser and for separation of the main part of the turpentine content from the condensate mixture and for removal of turpentine from the plant, and for transporting remaining condensate back to the space in the first unit into which the unclean condensate flows. There is also means for removal from the plant of condensed methanol from the bottom side space of the subsequent condenser.

The insertions may be either tubes or lamella. The plant may also have means for supply of de-aeration steam from one or more evaporation stages to the space in the first unit where unclean condensate is introduced. According to a preferred embodiment of the invention a first unit in the form of a combined stripper/condenser has a downward extension having insertions through which primary cleaned condensate flows, which insertions are surrounded with a space for through flowing of a de-aeration steam from one or more evaporation stages counter current with the primary cleaned condensate. The extension has a bottom, from which high-grade cleaned condensate is removed according to previously mentioned means and further means for the supply of steam and removal of the residual indirect heating steam. The just mentioned insertions are preferably tubes.

According to one more preferred embodiment of the invention there is an arrangement for creating a negative pressure which is connected to the bottom of the last in series condenser. This permits removal of inert gases and foul smelling sulphur containing gases. The number of condensers connected in series is not critical, but it has been shown than an appropriate number is four, with the first as a combined stripper and condenser. By connected in series is meant that the condensers are connected in sequence with each other. For example, the first and the second condenser can be connected with a space at the top and above the condensers and the second and the third are connected with a space at the bottom end below the condensers and the third and fourth condensers are connected with a space above the condensers. The fourth or commonly the last condenser in series can either be placed in close connection with the next to the last condenser or it can be placed separate from the next to last condenser. In the first case a common cooling agent system can be used for all condensers, for example four condensers, while in the second case a special cooling agent system will be used, where methanol is collected and removed. This make it possible to use a powerful cooling agent system, which means that a number of sulphur containing gases will condense and will mix with the condensed methanol. In that way, the volume of the residual or inert gases which have to be collected at the end part of the plant, will be reduced, while at the same time the volume of condensed liquor will increase in that position. As the recovered methanol normally will be sent to some equipment for incineration, it is favourable to eliminate the sulphur containing agents, which otherwise will appear as very voluminous gases.

It is preferable to build all condensers, for example four, in a common surrounded space. However, the last condenser can be placed separately. According to the design, the invention comprises means for taking out part of the removed methanol for reflux to the space above the next to the last condenser in series.

To increase the stripping efficiency in the first unit, the combined stripper and condenser, it is suitable to apply means for increasing the surface contact inside the tubes i.e. the contact between the condensate and the stripper steam, process steam. The means for doing this can be two joint plates inside the tube creating any type of pattern, for example a cross. For further increasing the efficiency, the means can be twisted along the longitudinal axes creating a spiral form. The means can also be corrugated plates. The means can be in contact with the tubes inside the wall or can be placed a distance from the inside wall. It is of course possible to join more than two plates, for example three or four, creating different types of patterns.

According to the present invention it is preferred that the total amount of steam necessary for cleaning the unclean condensate be low value, cheap steam, which is available as a residual product from the evaporation of spent liquor. That contributes to low operating cost for the cleaning process. The fixed cost i.e. the investment cost for the cleaning plant will be reduced to a great extend depending on the design of the combined stripper and condenser. Further, according to the invention, it is possible to reduce the main part of the cleaning plant to one unit i.e. all condensers are enclosed for example in a cylindrical building, or a cylindrical tower. That implies on one hand that the cost of material will be reduced and on the other that the space necessary for the plant also will decrease. For pulp mills, which have a shortage of space, this fact is of big importance. Further, according to the invention, it will be possible to increase the cleaning efficiency to 95% and even higher which gives big environmental advantages. In some cases it can be necessary to use admission steam for reaching a high degree of cleaning, but for special cases it can be worth it in comparison with other measures.

The Preferred Embodiment

In the following, the process of the invention as well as a plant for practicing the invention are described with reference to the mentioned figures, and the circumstances and conditions for practicing the invention will be explained.

Figure 1:
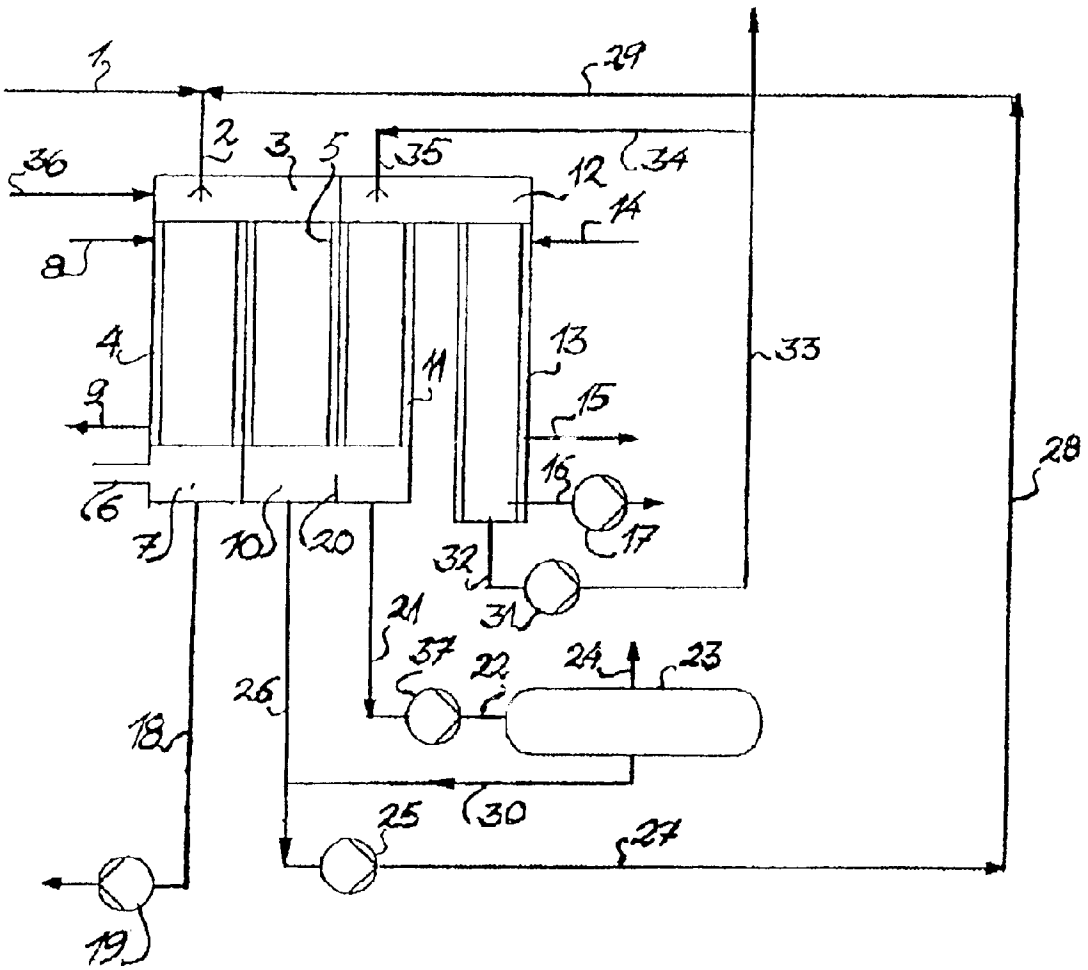
In FIG. 1 is shown schematically an embodiment of a cleaning plant according to the invention.

FIG. 1 is a schematic of a cleaning plant according to the inventions which can be used for cleaning unclean condensate to primary cleaned condensate, but not to maximum cleaned, high-grade, condensate.

Unclean condensate, for example, a mixture of digester condensate and evaporation condensate, feeds the space 3 through pipes 1 and 2 which are placed above combined stripper/condenser 4. Space 3 connects the combined stripper/condenser 4 with the subsequent condenser 5. Through pipe socket 6, process steam is supplied to space 7. Inside the stripper/condenser there are inserted tubes or lamella (not shown in the figure). Those insertions are surrounded by a space for coolant, for example, cold water. Coolant is supplied via pipe 6 and the heated coolant is discharged via pipe 9. It has been mentioned several times that the space for coolant is closed. This means that the coolant which surrounds the tubes is not in direct contact with the inside of the tubes, i.e. the cooling is indirect. Coolant is supplied in pipe 8 and discharged in pipe 9, with the space for the coolant being closed as described.

For the insertions which consist of tubes in unit 4 the length of the tubes are the same as the length of unit 4, one of the open ends is toward space 7 and the other open end is toward space 3. The open ends are surrounded by a joint unit, for example a sheet of iron.

Unclean condensate is distributed by pipe 2 over the unit 4 cross section and the condensate flows downward through the tubes by action of gravity. The process steam which is supplied to the space 7, i.e. the opposite end of unit 4, flows upward through the tubes and meets the down flowing unclean condensate. When process steam and unclean condensate are flowing counter current, stripping of the condensate occurs, i.e. the main part of the volatile components in the unclean condensate leave the condensate in a gaseous state and follows the remaining uncondensed process steam upward and from unit 4 to the space 3. The condensate gets cleaner and cleaner when the condensate flows downward in the unit 4 tubes. At this time as cleaning of the condensate occurs, the indirect cooling of the tubes means that the process steam will condense inside the tubes. The degree of condensation is dependent on several factors, but the condensation degree can, for example be 70–75%. That means that only 25–30% of the supplied process steam reaches the space 3. The condensate from the condensed process steam flows downwards with the cleaned condensate, the condensate mixture collecting in the space 7. The remaining process steam flows via space 3 further down through the tubes, for example, which are in condenser 5 (not shown in the figure). In the tubes of condenser 5 only process steam is flowing. However the tubes are surrounded with coolant, which implies further condensation of water. At the same time, and even before, turpentine will condense, with the turpentine and water flowing downward on the tube walls to the space 10. This gives a mixture, with turpentine as a top layer on water. The remaining process steam flows via the space 10 in to the third condenser 11 in the series. The steam flows upward through the tubes, for example, in condenser 11 (not shown in the figure) and reaches space 12. Condensation of turpentine and water will be continuous. The remaining steam flows through space 12 and downward through condenser 13, and through tubes, (not shown in the figure). In condenser 13 mainly methanol will condense, and will be collected at the bottom. If the condensate has its origin from sulphate pulping, and the temperature of the coolant which is supplied via pipe 14 and removed once heated via pipe 15, is about the same temperature as the temperature of the coolant referenced earlier, sulphur compounds will condense, for example dimethylsuphite. The remaining uncondensed agents are removed from the plant in a gaseous state via pipe 16 and arrangement 17.

The temperature of the process steam, which is supplied to the plant via the pipe socket 6, depends on the type of evaporation plant for spent liquor. There are evaporation plants which work at overpressure; the process steam in such plants has a temperature higher than 100° C., which can then be used according to the invention. In such cases, arrangement 17 can be a simple valve or a fan. Normally evaporation plants operate so that the process steam has a temperature less than 100° C. and for example 60–65° C. That implies that the process steam has its origin from parts which have a negative pressure. In those cases arrangement 17 must consist of a device which creates negative pressure, for example a vacuum pump or an ejector. Appropriate pressure is in both cases, about 10–20 kPa (0,1–0,2 bars). The temperature of the coolant, for example water, can vary. 10° C. is an example of a suitable temperature. Such a temperature is natural in the Nordic countries for example Sweden at least during the winter season. During the summer season, and in other cases, the water can be cooled down to about 10° C. with a refrigerating machine. When the process steam has a temperature of 60° C. the heated coolant will have a temperature of about 50° C., when the coolant is water. The primary cleaned condensate is removed via pipe 18 by use of a pump 19.

Approximately in the middle of space 10 there is an overflow 20, and the upper edge is, for example, cogged. As the condensed mixture of water and turpentine, in condenser 5, is collected in space 10, the turpentine forms a layer on the water and overflows to the right section of space 10. The turpentine-enriched condensate is pumped with pump 37 via pipes 21 and 22 to container 23, in which there often is an overpressure, which is created, by the pump. Separation of turpentine and water continue in the container. The turpentine, which is purified in two steps, is removed from the system via pipe 24. Contaminated water, which is in the left side of space 10, is transported by pump 25 via pipes 26, 27, 28 and 29 back to the system and mixed with a new influx of unclean condensate which enters space 3 above the combined stripper/condenser 4 via pipe 2. The water phase in the container 23 feeds the pipe 26 via pipe 30.

It is not necessary to use the over flow 20 with the aim to make a first coarse decanting of the water/turpentine mixture. It is of course possible to transport the mixture from space 10 to a separate unit (not shown in the figure) where an optimal separation of turpentine can be done. Those two liquid streams are handled in the same way as earlier described. In the bottom of condenser 13, a condensate of mainly methanol is collected. With pump 31, methanol is pumped from the system via pipes 32 and 33. Normally methanol is transported to some arrangement for incineration. In order to optimize the cleaning process it is preferably that a fraction of the methanol which is transported via pipe 33 re-circulate via pipes 34 and 35 to the left side of space 12 above the condenser 11. Since condenser 13 is separate from the other three condensers 4, 5 and 11 and has a separate system for coolant, this makes it possible to increase the condensation efficiency further so that more sulphur containing gases will condense, for example, when unclean condensate from sulphate pulping is purified according to the invention. By means of a refrigeration machine, the coolant temperature can be reduced to about 0° C.

Via pipe 36, de-aeration steam from the evaporation plant can be supplied to the cleaning plant where the aim is to clean the steam, such that the main part of the steam impurities will condense and may be recovered.

Figure 2:
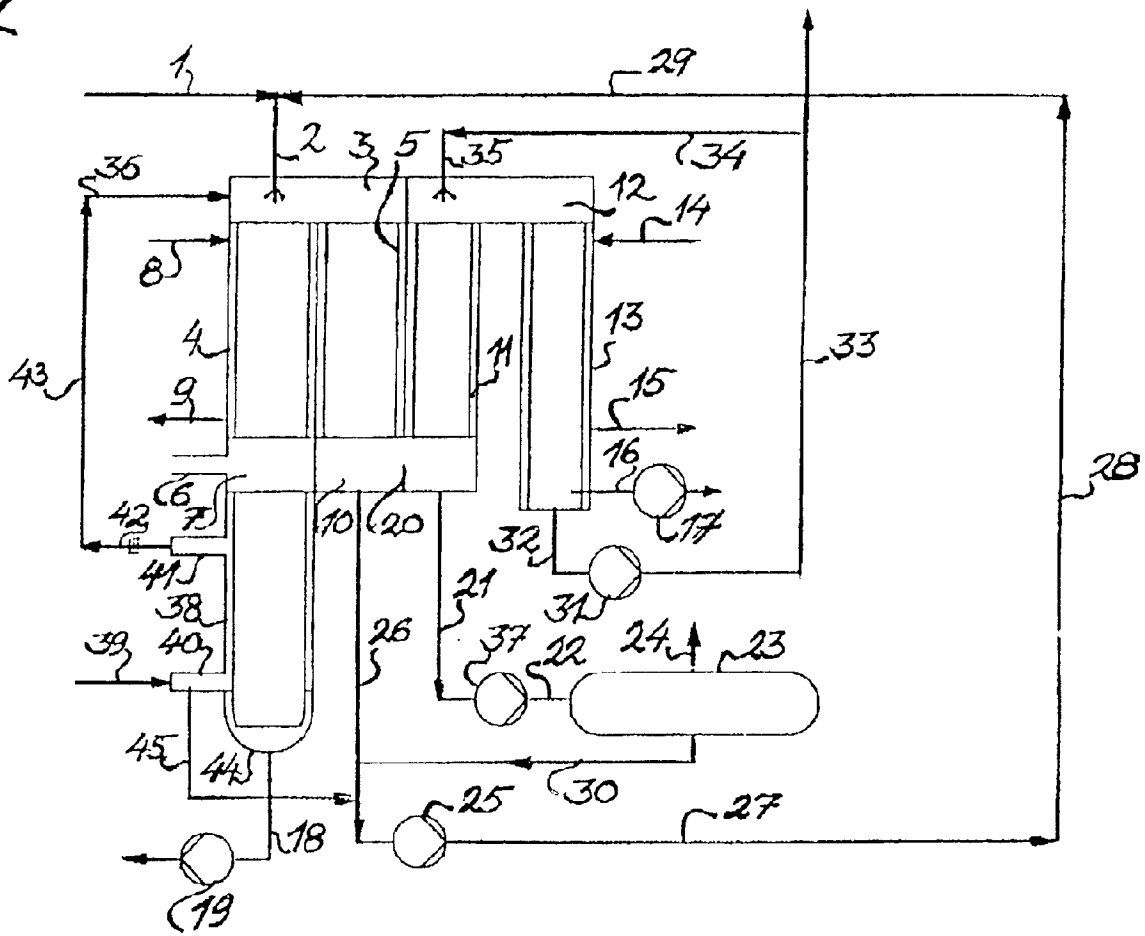
In FIG. 2 is shown schematically a preferred embodiment of a cleaning plant according to the invention.

In FIG. 2 is shown a schematically preferred embodiment of a cleaning plant according to the invention. The cleaning plants of FIGS. 1 and 2 are quite similar and for that reason identifying numerals used for FIG. 2 are the same as in FIG. 1 for objects which are in conformity. The difference between the two cleaning plants is that the preferred cleaning plant according to FIG. 2 has a completion extension 38 running downward from the combined stripper/condenser 4. The extension 38 also has insertions for tubes or lamella (not shown in the figure). Those insertions are surrounded with a closed space for a heating steam. The heating steam is de-aeration steam from one or more evaporation stages in the evaporation plant. The de-aeration steam is supplied via pipe 39 to pipe socket 40. In the case where the insertions are tubes, the heating steam flows along the tubes, which have a temperature of 70–80° C. or slightly higher. Remaining steam not condensed leaves unit 38 via the pipe socket 41 and pipes 42 and 43. The last-mentioned pipe is connected to pipe 36 and remaining de-aeration steam is supplied to space 3 for cleaning according to the earlier description.

The primary cleaned condensate, which leaves the combined stripper/condenser 4 flows via space 7 downwards to extension 38 and through the tubes, for instance, which are in the whole length of the extension and end in extension bottom 44. In the opposite direction of the primary cleaned condensate, inside the tubes, indirectly heated steam is flowing outside the tubes. As the condensate in question has a temperature of, for example, 60–65° C., and the heating steam a temperature of, for example, 70–80° C., the condensate will be heated somewhat as the condensate flows downward through the tubes. That implies that a fraction of the impurities which are still in the condensate leave the condensate in a gaseous state. The gas flows upward through the tubes and reaches space 7 where the gas mixes with a new influx of process steam which, as earlier mentioned, is supplied via the pipe socket 6. That gas-mixture flows upwards through the combined stripper/condenser as earlier described. The description above means that the primary cleaned condensate is further cleaned and transform to highly cleaned condensate which collects at bottom 44.

Via pipe 18 and by means of pump 19 the highly cleaned condensate is removed from the cleaning plant.

The amount of de-aeration steam from the evaporation plant is limited, and the amount of condensate, which flows downward extension 38, is large. Although the temperature differential between the two media can be large, the temperature increase in the condensate will increase only slightly given the large amount of condensate in comparison with the amount of steam. The temperature increase of the condensate is enough for further cleaning the condensate.

A fraction of the de-aeration steam will condense when it flows upward in the unit 38; the condensate collects in the bottom of the earlier mentioned closed space, including pipe socket 40. The condensate in question goes via pipe 45 to pipe 26 and mixes with contaminated water, which will be re-circulated in the plant as earlier described. The remaining steam in space 3 and forward will be handled in accordance with what was earlier mentioned and shown in FIG. 1.

Figure 3:
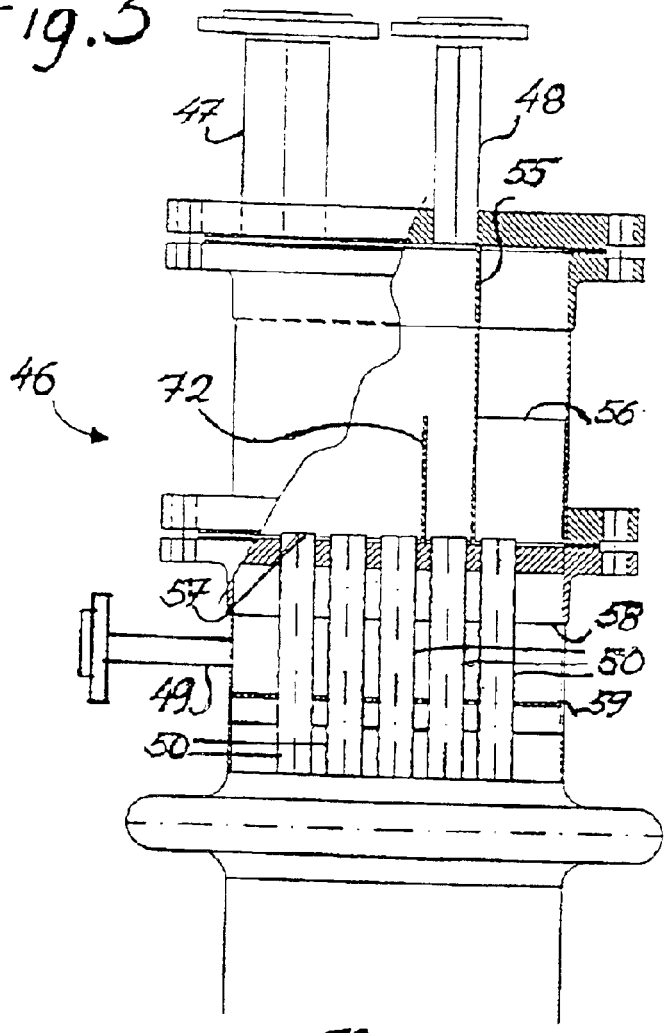
In FIGS. 3, 4, 5 and 6, are shown in more detail the central parts of another preferred embodiment of the cleaning plant according to the invention.
Figure 4:
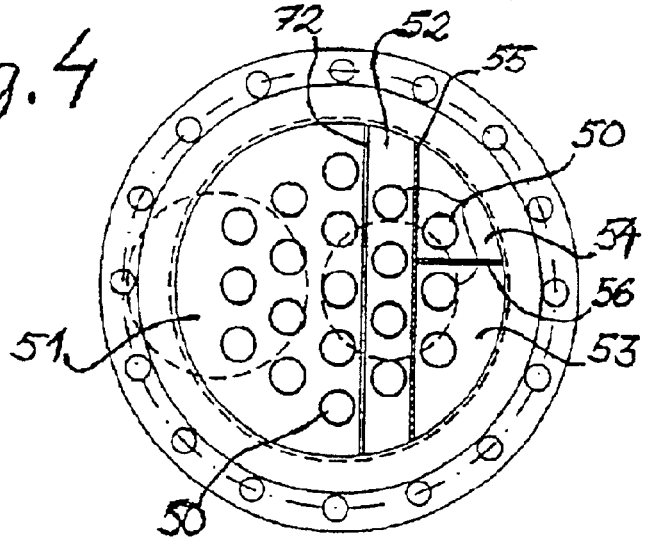

FIGS. 3 and 4 show the over part of central section of a preferred embodiment of a cleaning plant according to the invention. Those central parts constitute four condensers enclosed in a longitudinal cylindrical tower, with the first unit a combined stripper/condenser. FIGS. 3, 4, 5 and 6 do not show unit 38 according to figure 2 or other supplementary equipment in the cleaning plant according to the invention, which are clear from FIG. 2 and FIG. 1. The over section of tower 46 is shown from the side in FIG. 3 and in cross section in FIG. 4. Through pipe socket 47, unclean condensate and condensate from the bottom of the second condenser in series, is supplied. Through pipe socket 48, a part of condensed methanol is re-circulated, and is collected at the bottom of the fourth condenser in series. Through pipe socket 49 coolant, for example cold water, is supplied. Tower 46 contains a large number of tube 50. Those tubes are surrounded by a joint means 59, for example, a sheet of iron.

The left part 51 of the tower, which clearly can be seen in cross section in FIG. 4, is a combined stripper and condenser. To the right is the second condenser, 52 in series. There is a wall 72 that separates the combined stripper condenser 51 from condenser 52. The wall 72 doesn't reach up to the tower 46 top, but the process steam flows up through the tubes 50 in unit 51, over the wall 72 and downward through the tubes 50 in unit 52. Unit 53 is connected with the third condenser 53 in series at the bottom of unit 52. Unit 52 is connected with the fourth condenser, 54 at the top of the tower 46.

The wall 55 that separates the condensers 53 and 54 is at the top of the tower 46. The wall 56 that separates condenser 53 from condenser 54 doesn't reach the top of tower 46. The number of tubes 50 that is shown in the combined stripper condenser 51 is twelve. The corresponding number of tubes 50 in condenser 52 is four, while the number of tubes in the third condenser 53 is two and in the last condenser one. This is a result of the fact that more and more steam will condense, and therefore the necessary cooling capacity is decreased. The plant is designed so that ⅔ of the supplied process steam will condense inside tubes 50 when the steam has reached the upper end, 57, in the combined stripper and condenser. Coolant is supplied, as earlier described, in a closed space. The space is restricted at the top by a means, for example a sheet of iron. Prior mentioned means 59, for example a sheet of iron, is not close connected to the tubes 50. On, for example, four points of the tubes periphery, the tubes will be connected with the means. Those points can be on the top of a half circle shaped pattern, which will put the tubes into an exact position. Between the points there is a space between the means and the tube, which will help the supplied coolant to flow along the tubes 50, outside, and down through tower 46. Such means, 59, are applied to the tubes, with for example a distance of two meters, down through the tower. The means have two purposes. The tubes will be efficiently cooled, as cold water flows along the outside of the tubes, and the tubes will also be reinforced efficiently by the means.

Figure 5:
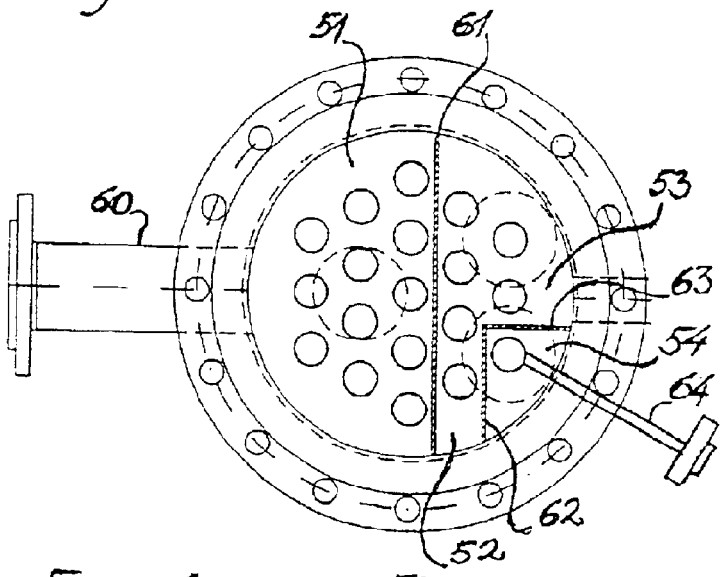
Figure 6:
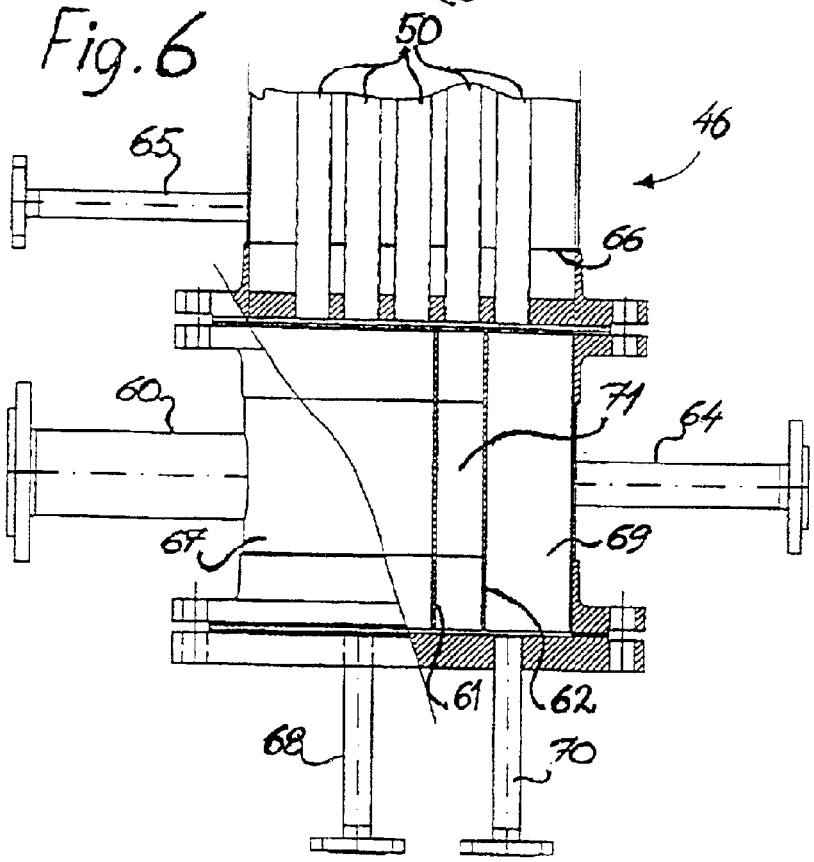

In FIGS. 5 and 6 shows the lower section of the tower 46.

FIG. 5 shows a cross section of tower 46, seen from the bottom side. Process steam is supplied through pipe socket 60 to the combined stripper and condenser 51. The wall 61 separates the stripper and condenser from the condensers 52 and 53. Condensers 52 and 53 are connected with each other at the bottom side such that the process steam can flow from condenser 52 up through condenser 53. From there process steam flows, in a volume which diminishes after each condenser, downward through condenser 54. That is separated from condenser 52 by the wall 62 and from condenser 53 by wall 63. Via pipe socket 64 insert gases are removed, including eventually foul smelling sulphur containing gases and according to a preferred embodiment of the invention pipe socket 64 is connected to an arrangement for creating negative pressure (not shown in the figure).

FIG. 6 shows pipe socket 65, through which heated coolant is removed. A closed space for coolant is restricted downward by a means 66, for example a sheet of iron. At the bottom of the space 67, clean condensate is collected and is removed from the plant via pipe socket 68. In the bottom of space 69, below condenser 54, condensed methanol is collected and removed via pipe socket 70. In the bottom of space 71 is a mixture of turpentine and contaminated water; the mixture is removed via pipe socket (not shown in the figure) for separation of turpentine and re-circulation of remaining condensate according to earlier descriptions.

FIGS. 3, 4, 5 and 6 do not differ from the condensers 4, 5, 11 and 13 with corresponding spaces 7, 3, 10 and 12, and connecting pipes including pipe sockets according to the FIGS. 1 and 2, but show a similar cleaning plant which is extremely compact and therefore requires a minimum of space.

What is claimed is:

1. Method for purification of unclean condensate resulting from production of semichemical or chemical cellulose pulp and from evaporation of spent liquor by means of a cleaning plant having in series several coupled condensers comprising the steps of:

(a) feeding vapor generated during a last evaporation stage, which is process steam from such last evaporation stage, together with unclean condensate into a combined stripper and condenser, the process steam and the unclean condensate being forced to flow in opposite directions so that direct heat exchange takes place and heat is transferred from the process steam to the unclean condensate resulting in separation of turpentine, methanol and other volatile compounds in the unclean condensate which turpentine, methanol and other volatile compounds are taken up by the flow of process steam at the same time as indirect cooling occurs, resulting in condensation of a main part of the process steam to form a primary cleaned condensate;

(b) causing a remainder of the process steam with the turpentine, methanol and other volatile compounds to flow to another condenser, the remainder of the process steam with the turpentine, methanol and other volatile compounds being cooled indirectly such that contaminated water and turpentine are condensed and collected together and, that methanol thereafter will be condensed;

(c) separating the contaminated water from the main part of the turpentine content which is removed from the plant;

(d) circulating the contaminated water back to the combined stripper and condenser;

(e) condensing the methanol and removing the condensed methanol from the plant;

(f) collecting the primary cleaned condensate at a bottom of the combined stripper and condenser; and (g) removing the primary cleaned condensate from the plant.

2. Method according to claim 1, wherein all of the process steam from the last stage of evaporation of the spent liquor is introduced into the combined stripper and condenser.

3. Method according to claim 1, wherein, during the feeding step, the unclean condensate is introduced into a space above and in connection with the combined stripper and condenser, and the process steam is introduced into a space under and in connection with the combined stripper and condenser, and the unclean condensate flows in a direction downward through the combined stripper and condenser, while the process steam flows in an opposite direction.

4. Method according to claim 3, wherein de-aeration steam from at least one evaporation stage is introduced into a space in connection with the combined stripper and condenser.

5. Method according to claim 3, wherein, during the primary cleaned condensate removing step, the primary cleaned condensate is forced to flow downward through an underlying extension of the combined stripper and condenser and is heated indirectly by de-aeration steam of at least one evaporation stage, which de-aeration steam is introduced at an under part of the extension, resulting in remaining turpentine, methanol and other volatile compounds in the primary cleaned condensate being separated from the primary cleaned condensate in a gaseous state and flowing upward and being mixed with the upward flowing, newly introduced de-aeration steam such that a highly purified condensate is collected at a bottom of the extension and removed from the plant.

6. Method according to claim 5, wherein the de-aeration steam is mixed with admission steam of variable energy content so that cleanliness of the highly purified condensate can be closely controlled.

7. Method according to claim 5, wherein any uncondensed de-aeration steam is discharged at the upper part of the extension, and is introduced into a space in connection with the combined stripper and condenser.

8. Method according to claim 1, further comprising the step of removing inert gases and sulphur containing gases from the plant by means of an arrangement for creating negative pressure which is connected to a discharge end of the plant.

9. Method according to claim 1, wherein, during the methanol condensing step, methanol is collected at the bottom of a last condenser in series, and a portion of the methanol is removed from the plant, and a portion of the removed methanol is recirculated to the top of the next to last condenser in series.

10. Method according to claim 1, further comprising the steps of supplying at least one coolant to an upper section of the combined stripper and condenser and removing the coolant at an increased temperature from a point below the upper section of the combined stripper and condenser.

11. A plant for cleaning of unclean condensate from production of chemical or semi-chemical pulp including evaporation of spent liquor, comprising:

(a) a combined stripper and condenser, having several insertions through which process steam and unclean condensate flow counter current and in direct contact with each other, which insertions are surrounded by a space intended for through-flow by a coolant and spaces connected on a topside and an underside of the combined stripper and condenser, the space on the underside serves as a bottom of the combined stripper and condenser;

(b) means for supplying unclean condensate to the space at the topside of the combined stripper and condenser;

(c) means for supplying process steam to the space at the underside of the combined stripper and condenser;

(d) further condensers connected in series with the combined stripper and condenser, the further condensers having several insertions through which residual, uncondensed process steam and turpentine, methanol and other volatile compounds generated from the unclean condensate flow, which insertions are surrounded by a space intended for through flow by coolant, resulting in condensation in series of contaminated water and turpentine in a mixture and methanol in spaces connected to the respective condensers;

(e) means for supplying coolant to the spaces surrounding the insertions of the combined stripper and condenser and the further condensers;

(f) means for removing heated coolant from the spaces surrounding the insertions of the combined stripper and condenser and the further condensers;

(g) means for removing primary cleaned condensate from the bottom of the combined stripper and condenser;

(h) means for separating a main part of the turpentine from the contaminated water and turpentine mixture;

(i) means for removing a main part of the turpentine from the plant;

(j) means for transporting the contaminated water back to the space in the combined stripper and condenser where the unclean condensate is introduced; and (k) means for removing the condensed methanol out of the plant from the space in which the condensed methanol is condensed.

12. Plant according to claim 11, wherein said insertions are tubes.

13. Plant according to claim 12, further including means for increasing contact surface between the unclean condensate and the process steam inserted inside the tubes.

14. Plant according to claim 13, wherein said means for increasing contact are chosen from the group consisting of two joined elongated elements which in cross section form a cross, a folded sheet iron creating a wave pattern and elongated elements twisted along their longitudinal axis giving a spiral pattern.

15. Plant according to claim 11, wherein said insertions are lamellae.

16. Plant according to claim 11, further comprising means for supplying de-aeration steam from at least one evaporation stage to the combined stripper and condenser.

17. Plant according to claim 11, further comprising a downward extension connected to the combined stripper and condenser, the downward extension having insertions through which primary cleaned condensate from the combined stripper and condenser flows in one direction and primarily de-aeration steam, from at least one evaporation stage flows counter current with the primary cleaned condensate, the extension has a bottom from which highly purified condensate is removed.

18. Plant according to claim 17, wherein insertions of the downward extension are tubes.

19. Plant according to claim 11, wherein a lower part of the last of the further condensers in series is a device arranged for creating a negative pressure inside of the insertions of the further condensers and their connecting spaces and for removal of mainly inert gases and foul smelling sulphur containing gases.

20. Plant according to claim 11, wherein the further condensers are three condensers.

21. Plant according to claim 11, wherein said means removing the condensed methanol from the plant includes means for recirculation of at least some of such methanol to a space above the next to the last condensers of the further condensers in series.

* * * * *